US012773002B2

(12) United States Patent
Martin

(10) Patent No.: US 12,773,002 B2
(45) Date of Patent: Oct. 27, 2026

(54) DRIED AEROSOL-GENERATING MATERIAL AND USES THEREOF

(71) Applicant: Nicoventures Trading Limited, London (GB)

(72) Inventor: Stuart Martin, London (GB)

(73) Assignee: NICOVENTURES TRADING LIMITED, London (GB)

( * ) Notice: Subject to any disclaimer, the term of this patent is extended or adjusted under 35 U.S.C. 154(b) by 489 days.

(21) Appl. No.: 18/262,132

(22) PCT Filed: Jan. 28, 2022

(86) PCT No.: PCT/GB2022/050225
§ 371 (c)(1),
(2) Date: Jul. 19, 2023

(87) PCT Pub. No.: WO2022/162374
PCT Pub. Date: Aug. 4, 2022

(65) Prior Publication Data

US 2024/0090562 A1 Mar. 21, 2024

(30) Foreign Application Priority Data

Jan. 29, 2021 (GB) ..... 2101230

(51) Int. Cl.
*A24B 15/24* (2006.01)
*A24B 15/10* (2006.01)
(Continued)

(52) U.S. Cl.
CPC ..... *A24B 15/24* (2013.01); *A24B 15/10* (2013.01); *A24B 15/285* (2013.01);
(Continued)

(58) Field of Classification Search
None
See application file for complete search history.

(56) References Cited

U.S. PATENT DOCUMENTS 5,129,409 A * 7/1992 White ..... A24B 15/165 131/84.1
2018/0279666 A1* 10/2018 Aoun ..... A24B 15/32
2022/0053815 A1* 2/2022 Bigot ..... A24B 9/00

FOREIGN PATENT DOCUMENTS

CN 110367581 A 10/2019
CN 110881684 A 3/2020
(Continued)

OTHER PUBLICATIONS

Calín-Sánchez et al., Comparison of Traditional and Novel Drying Techniques and Its Effect on Quality of Fruits, Vegetables and Aromatic Herbs. Foods. 2020; 9(9):1261, [online], retrieved from the Internet, [retrieved Jun. 5, 2026], URL: https://doi.org/10.3390/foods9091261 (Year: 2020).*
(Continued)

*Primary Examiner* — Dennis R Cordray
(74) *Attorney, Agent, or Firm* — WOMBLE BOND DICKINSON (US) LLP

(57) ABSTRACT

A dried aerosol-generating material, methods of manufacturing the dried aerosol-generating material and uses thereof. The dried aerosol-generating material may be used directly as an aerosol-generating material, and/or treated with water to provide a conventional aerosol-generating material. The aerosol-generating material may be used in combustible or non-combustible aerosol-provision systems.

21 Claims, 1 Drawing Sheet

(51) Int. Cl.

| | |
|---|---|
| ***A24B 15/28*** | (2006.01) |
| ***A24B 15/40*** | (2006.01) |
| ***A24D 1/20*** | (2020.01) |
| ***A24F 40/20*** | (2020.01) |

(52) U.S. Cl.
CPC ..... *A24B 15/403* (2013.01); *A24D 1/20* (2020.01); *A24F 40/20* (2020.01)

(56) References Cited

FOREIGN PATENT DOCUMENTS

| | | | |
|---|---|---|---|
| EP | 0405190 | A2 | 1/1991 |
| EP | 3782481 | A1 | 2/2021 |
| JP | S498877 | B1 | 2/1974 |
| JP | 2019501667 | A | 1/2019 |
| WO | 20160184977 | A1 | 11/2016 |
| WO | 2017089939 | A1 | 6/2017 |
| WO | 2017097840 | A1 | 6/2017 |
| WO | 2020025727 | A1 | 2/2020 |
| WO | 2020028468 | A1 | 2/2020 |
| WO | 2020115166 | A1 | 6/2020 |
| WO | WO2021224604 | A1 | 11/2021 |

OTHER PUBLICATIONS

International Search Report and Written Opinion in International Appln. No. PCT/GB2022/050225, dated May 2, 2022, 18 pages.

* cited by examiner

DRIED AEROSOL-GENERATING MATERIAL AND USES THEREOF

PRIORITY CLAIM

The present application is a National Phase entry of PCT Application No. PCT/GB2022/050225, filed Jan. 28, 2022, which claims priority from GB Application No. 2101230.7, filed Jan. 29, 2021, each of which is hereby fully incorporated herein by reference.

TECHNICAL FIELD

The invention relates to a dried aerosol-generating material, methods of manufacturing a dried aerosol-generating material and uses thereof.

BACKGROUND

Aerosol-generating materials for use in a combustible or a non-combustible aerosol provision system may include a variety of different active substances and/or flavors and a user selects aerosol-generating material to provide the desired user experience. Drawbacks associated with such aerosol-generating materials can include, for example, smaller proportions of the constituents being released during the normal use of the product over time and after storage of the aerosol-generating material, and a shorter shelf-life. There is therefore a need to improve the shelf-life of such aerosol-generating materials.

SUMMARY

According to a first aspect of the present invention, there is provided a dried aerosol-generating material comprising a spray-dried or freeze-dried precursor material comprising an extract from a flavor- and/or active-containing plant material and an aerosol-former material.

In some embodiments, the aerosol-former material is glycerol.

In some embodiments, the precursor material further comprises at least one excipient.

In some embodiments, the excipient is one or more selected from the group consisting of mannitol, sucrose, trehalose, lactose, sorbitol, raffinose, maltose, Dextran 10, Dextran 70, Dextran 90, maltodextrin, gelatin, agar, cyclodextrin, PEG 2000-6000 and polyvinylpyrrolidone (PVP) (10 k).

In some embodiments, the precursor material comprises from about 10 to about 95% by weight extract from a flavor- or active-containing plant material.

In some embodiments, the precursor material comprises from about 1 to about 36 wt % aerosol-former material.

In some embodiments, the precursor material comprises from about 0 to about 40% by weight excipient.

In some embodiments, the dried aerosol-generating material comprises from about 99 to about 45% by weight dried extract from the flavor- or active-containing plant material.

In some embodiments, the dried aerosol-generating material comprises from about 1 to about 34% by weight aerosol-former material.

In some embodiments, the dried aerosol-generating material comprises from about 0 to about 25% by weight excipient.

In some embodiments, the plant material is selected from the group consisting of tobacco, eucalyptus, star anise, cocoa and hemp.

In some embodiments, the extract from a flavor- or active-containing plant material is an aqueous extract. In some embodiments, the extract from a flavor- or active-containing plant material is an aqueous tobacco extract.

In some embodiments, the dried aerosol-generating material comprises from about 40 to about 99% by weight tobacco solids.

In some embodiments, the dried aerosol-generating material is in the form of granules. In some embodiments, the granules have a particle size that is at most about 3 mm.

In some embodiments, the dried aerosol-generating material has a water content of no more than about 5%.

In some embodiments, the dried aerosol-generating material is for use in an aerosol provision system.

According to a second aspect of the present invention, there is provided a non-combustible aerosol-provision system comprising the dried aerosol-generating material according to the first aspect.

According to a third aspect of the present invention, there is provided a method of providing a dried aerosol-generating material comprising spray-drying or freeze-drying a precursor material comprising an extract from a flavor- and/or active-containing plant material and an aerosol-former material.

In some embodiments, the dried aerosol-generating material according to the first aspect is contacted with water.

In some embodiments, contacting the dried aerosol-generating material with water comprises exposing the dried aerosol-generating material to a humid environment.

In some embodiments, an aerosol-generating material is provided in the form of a solid, liquid or gel aerosol-generating material.

In some embodiments, a solid amorphous material is formed from the dried aerosol-generating material.

BRIEF DESCRIPTION OF THE DRAWINGS

Embodiments of the invention will now be described, by way of example only, with reference to accompanying drawings, in which.

DETAILED DESCRIPTION OF THE DRAWINGS

Figure 1:
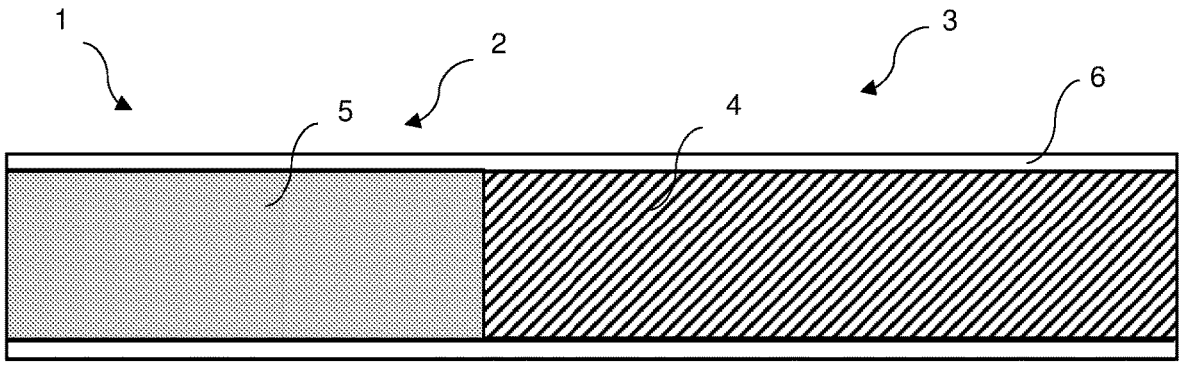
FIG. 1 is a side-on cross sectional view of a first embodiment of a consumable comprising a dried aerosol-generating material.

The present invention relates to a dried or dehydrated aerosol generating material. The dried aerosol-generating material may be used directly as an aerosol-generating material, and/or it may be treated with water to provide a rehydrated aerosol-generating material with a more conventional water content.

The aerosol-generating material may be used in combustible or non-combustible aerosol provision systems, or in an aerosol-free delivery system.

An aerosol-generating material is a material that is capable of generating aerosol, for example when heated, irradiated or energized in any other way. The aerosol-generating material may, for example, be in the form of a solid, liquid or gel which may or may not contain an active substance and/or flavorants. The aerosol-generating material may be provided in a dehydrated or hydrated form. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavours, optionally one or more aerosol-former materials, and optionally one or more other functional material.

Combustible and non-combustible aerosol-generating devices, including hybrid devices, may contain aerosol-generating material which may comprise tobacco material or a tobacco extract which is used to provide the user with an aerosol with an authentic tobacco taste and texture. One issue encountered with such devices is that the flavor and the volatile compound and nicotine content decreases with storage of the aerosol-generating material, dropping off particularly towards the end of the life of the material. This is because the more volatile components, including nicotine and many flavors and aromas, are readily released from the surface of the tobacco material. Additionally, as the aerosol-generating material becomes increasingly damp with water, the release of active substances such as nicotine and flavors is negatively impacted. There is therefore a need to improve the shelf life of the aerosol generating material.

The invention enjoys the advantage of a dried aerosol-generating material that has an increased shelf life and may be easily transported and stored. Aerosol-generating materials that are produced using conventional methods and procedures commonly need to be used within one to three days of production. The dried aerosol-generating materials described herein are stable at a range of temperatures and humidities and have an increased shelf-life, and are therefore easy to store and transport. In some embodiments, the dried aerosol-generating material may be stored at temperatures in the range storage temperatures in the range 0-35° C. In some embodiments, the dried aerosol-generating material may be stored at a relative humidity of up to about 30%.

A further advantage of the dried aerosol-generating materials is that they may be used directly as a solid substrate in hybrid systems or Tobacco Heating Products (THPs). This makes the invention versatile enough to be used in a range of products without the need for further processing.

The dried aerosol-generating material comprises a spray-dried or freeze-dried precursor material comprising an extract from a flavor- and/or active-containing plant material and an aerosol-former material.

The Precursor Material

In some embodiments, the precursor material has a water content of at least 20 v/v % and comprises the components described herein.

The water content of the aerosol-generating material described herein may vary according to, for example, the temperature, pressure and humidity conditions at which the compositions are maintained.

The water content can be determined by Karl-Fisher analysis or by gas chromatography-thermal conductivity detector (GC-TCD), as known to those skilled in the art.

The precursor material may be in the form of a slurry, a suspension, a gel, a liquid or a solid, but in some embodiments which may be preferred, it is in the form of a suspension or liquid. The water content of the precursor material may be at least about 20 wt %, at least about 30 wt %, at least about 40 wt %, at least about 50 wt %, at least about 60 wt %, at least about 70 wt %, at least about 80 wt %, or at least about 90 wt %, and/or up to about 95 wt %, up to about 90 wt %, up to about 85 wt %, up to about 80 wt %, up to about 75 wt %, up to about 70 wt %, up to about 65 wt %, up to about 60 wt %, up to about 55 wt % or up to about 50 wt % on a wet weight basis. In some embodiments, the water content of the precursor material is between about 40 and about 50 wt % on a wet weight basis (50% and 60 v/v %). When the precursor material has a lower water content, the spray/freeze-drying process is quicker, as there is less water to remove.

The precursor material comprises an extract from a flavor- or active-substance containing plant material.

In some embodiments, the precursor material comprises tobacco material and/or a tobacco extract.

The tobacco extract or material may be from or may be any type of tobacco and any part of the tobacco plant, including tobacco lamina, stem, stalk, ribs, scraps and shorts or mixtures of two or more thereof. Suitable tobacco extracts or materials include the following types: Virginia or flue-cured tobacco, Burley tobacco, Oriental tobacco, or blends of tobacco materials, optionally including those listed here. The tobacco may be expanded, such as dry-ice expanded tobacco (DIET), or processed by any other means. In some embodiments, the tobacco material may be reconstituted tobacco material. The tobacco may be pre-processed or unprocessed, and may be, for instance, solid stems (SS); shredded dried stems (SDS); steam treated stems (STS); or any combination thereof. The tobacco material may be fermented, cured, uncured, toasted, or otherwise pre-treated. The tobacco material may be provided in the form of cut rag tobacco. The cut rag tobacco can have a cut width of at least 15 cuts per inch (about 5.9 cuts per cm, equivalent to a cut width of about 1.7 mm) for example. The cut rag tobacco can be formed from a mixture of forms of tobacco material, for instance a mixture of one or more of paper reconstituted tobacco, leaf tobacco, extruded tobacco and bandcast tobacco.

The precursor material may comprise at least about 10 wt %, at least about 15 wt %, at least about 20 wt %, at least about 25 wt %, at least about 30 wt %, at least about 35 wt %, or at least about 40 wt %, and/or up to about 60 wt %, up to about 55 wt %, up to about 50 wt %, up to about 45 wt %, or up to about 40 wt %, tobacco solids (calculated on a wet weight basis). In some embodiments, the precursor material comprises from about 20 wt % to about 40 wt % tobacco solids (calculated on a wet weight basis).

In some embodiments, the precursor material comprises at least about 10 wt %, about 20 wt %, at least about 30 wt %, at least about 40 wt %, at least about 50 wt %, at least about 60 wt %, at least about 70 wt %, at least about 80 wt %, at least about 90 wt %, and/or up to about 99 wt %, up to about 90 wt %, up to about 80 wt %, up to about 70 wt % or up to about 60 wt % tobacco or flavor- or active-substance containing plant material extract (calculated on a wet weight basis). In some embodiments, the precursor material comprises around 50 wt % tobacco extract (calculated on a wet weight basis).

In some embodiments, the precursor material comprises around 50 v/v % tobacco extract. Where the precursor material comprises around 50 v/v % tobacco extract and the tobacco extract has a tobacco solid content of between about 55 and about 60 v/v %, the overall tobacco solid content of the precursor material is from about 27.5 to about 30 v/v %.

In some embodiments, the tobacco extract has a solids content of between about 40 and about 65 wt %, between about 45 and about 65 wt %, or between about 40 and about 60 wt % (calculated on a wet weight basis). In some embodiments, the water content of the tobacco extract is between about 35 wt % and about 65 wt %, or between about 35 and about 55 wt % (calculated on a wet weight basis). In some embodiments, the nicotine content of the tobacco extract is between about 1 wt % and about 5 wt % (calculated on a wet weight basis).

In some embodiments, the tobacco extract is an aqueous tobacco extract. In some embodiments, the tobacco extract may be concentrated and subsequently diluted before being added to the precursor material and dried. In other embodiments, the tobacco extract is not concentrated and may be used directly in the precursor material.

In some embodiments, the extract from a flavor- or active-substance containing plant material comprises an active substance.

The active substance as used herein may be a physiologically active material, which is a material intended to achieve or enhance a physiological response. The active substance may for example be selected from nutraceuticals, nootropics and psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, cannabis or another botanical.

In some embodiments, the active substance comprises nicotine. In some embodiments, the active substance comprises caffeine, melatonin or vitamin B12.

In some embodiments, the precursor material may comprise an extract from other botanical source(s) along with or instead of the tobacco extract.

As noted herein, the active substance may comprise or be derived from one or more botanicals or constituents, derivatives or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v., *Mentha spicata crispa, Mentha cardifolia, Mentha longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from eucalyptus, star anise, cocoa and hemp.

In some embodiments, the active substance comprises or derived from one or more botanicals or constituents, derivatives or extracts thereof and the botanical is selected from rooibos and fennel.

In some embodiments, the extract from a flavor- or active-substance containing plant material is concentrated before it is dried. This may render the drying step more efficient, for example, requiring less energy. Also, this may help to provide the precursor material in a form that is suitable for the selected drying process. In some circumstances, the concentrated extract may be transported before it is dried and the smaller volume and weight of the concentrated extract when compared to the unconcentrated extract may provide further cost savings.

The precursor material further comprises an aerosol-former material.

The aerosol-former material may comprise one or more constituents capable of forming an aerosol. The aerosol-former may be, for instance, a polyol aerosol generator or a non-polyol aerosol generator. It may be a solid or liquid at room temperature, but preferably is a liquid at room temperature. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

In some embodiments, the aerosol former comprises one or more polyhydric alcohols, such as propylene glycol, triethylene glycol, 1,3-butanediol and glycerin; esters of polyhydric alcohols, such as glycerol mono-, di- or triacetate; and/or aliphatic esters of mono-, di- or polycarboxylic acids, such as dimethyl dodecanedioate and dimethyl tetradecanedioate. In some embodiments, the aerosol-former material comprises one or more compounds selected from erythritol, propylene glycol, glycerol, vegetable glycerine (VG), triacetin, sorbitol and xylitol. In some embodiments, the aerosol-former material comprises, consists essentially of or consists of glycerol. In a preferred embodiment, the aerosol-forming agent consists of glycerol. Glycerol provides a visible aerosol when the aerosol-generation device is used. It is common that consumers like the aerosol generating device to provide a visible aerosol, as this enables the consumer to visualise the product and what they are consuming. This makes glycerol a desirable choice for aerosol former material. Propylene glycol has the benefit that it is a better flavor carrier than glycerol.

A combination of aerosol forming agents may be used, in equal or differing proportions. The aerosol-former material may act as a plasticizer.

In some embodiments, the precursor material comprises at least about 1 wt %, at least about 5 wt %, at least about 10 wt %, or at least about 20 wt %, aerosol-former material (calculated on a wet weight basis).

The precursor material may comprise up to about 40 wt %, up to about 35, up to about 30 wt %, up to about 25 wt %, up to about 20 wt %, or up to about 10 wt % aerosol-former material (calculated on a wet weight basis).

In embodiments of the invention in which the aerosol-forming material is glycerol, the precursor material may comprise at most 36 wt % of glycerol. The inventors have demonstrated that dry weight inclusion levels up to 36 wt % (calculated on a dry weight basis) of aerosol-former material are possible.

The amount of glycerol in the precursor material, and therefore the dried aerosol material, is important because it is both an aerosol-forming material and also a plasticizer. If the concentration of glycerol it too high, it may be detrimental to a critical temperature of the product during the freeze-drying process and may result in collapse of the product if the critical temperature of the formulation is exceeded. On the other hand, sufficient glycerol should be included to provide the consumer with an adequate and pleasing aerosol.

In some embodiments, the precursor material further comprises one or more excipients. The excipient stabilizes and preserves the precursor material and the inventors have found the inclusion of an excipient especially important for stability when the precursor material comprised glycerol as the aerosol-forming material. The excipient may also act as a bulking agent or a filler material. Suitable excipients include mannitol, sucrose, trehalose, lactose, sorbitol, raffinose, maltose, Dextran 10, Dextran 70, Dextran 90, maltodextrin, gelatin, agar, cyclodextrin, PEG 2000-6000, (PVP 10 k).

In some embodiments, the precursor material comprises one or more excipients in an amount of from about 0 to about 40 wt % on a wet weight basis. In some embodiments, the precursor material may comprise at least about 1 wt %, at least about 10 wt %, at least about 20 wt %, at least about 30 wt %, and/or up to about 40 wt %, up to about 30%, or up to about 20 wt % excipient on a wet weight basis.

In embodiments in which the excipient is agar, the precursor material may comprise about 0 wt %, about 5 wt %, about 10 wt % agar. The inventors have found that agar makes the precursor material more viscous and that the freeze-drying process is easier when the precursor material comprises a lower concentration of the agar excipient.

In some embodiments, the precursor material comprises about 50 wt % tobacco extract, about 0 to about 36 wt % aerosol forming agent (or about 0-15 v/v %) and about 0 to about 40 wt % (37.5 v/v %) excipient. The tobacco extract may comprise about 55 wt % tobacco solids and the overall tobacco solids content of the precursor material is about 27.5 wt %.

In some embodiments, the precursor material comprises about 50 wt % tobacco extract, up to about 36 wt % (15 v/v %) glycerol and about 0 to about 40 wt % (37.5 v/v %) excipient. The tobacco extract may comprise about 55 wt % tobacco solids and the overall tobacco solids content of the precursor material is about 27.5 wt %.

In some embodiments, the precursor material comprises one or more binders. In some embodiments the one or more binder is selected from the group consisting of: thermoreversible gelling agents, such as gelatin; starches; polysaccharides; pectins; celluloses; cellulose derivatives, such as carboxymethylcellulose; and alginates.

In some embodiments one or more flavor-modifier, flavor or flavorant is included in the precursor material. As used herein, the terms "flavor" and "flavorant" refer to materials which, where local regulations permit, may be used to create a desired taste, aroma or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some embodiments, a flavor present in the precursor material is derived from the extract from a flavor- or active-substance containing plant material. Additionally or alternatively, a flavor not derived from the extract may be added to the precursor material. In some embodiments, the flavor is hydrophobic.

In some embodiments, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

In some embodiments, the precursor material comprises one or more other functional materials, which may comprise one or more of pH regulators, coloring agents, preservatives, fillers, stabilizers, and/or antioxidants.

In some embodiments, the precursor material contains a filler component. The filler component is generally a non-tobacco component, that is, a component that does not include ingredients originating from tobacco. In some embodiments, the precursor material comprises less than 60 wt % of a filler, such as from 1 wt % to 60 wt %, or 5 wt % to 50 wt %, or 5 wt % to 30 wt %, or 10 wt % to 20 wt % on a wet weight basis.

The filler, if present, may comprise one or more inorganic filler materials such as calcium carbonate, perlite, vermiculite, diatomaceous earth, colloidal silica, magnesium oxide, magnesium sulphate, magnesium carbonate, and suitable inorganic sorbents, such as molecular sieves. The filler may comprise one or more organic filler materials such as wood pulp, hemp fibre, cellulose and cellulose derivatives.

Spray-Drying and Freeze-Drying

The drying methods used to dry the precursor material may be any suitable freeze-drying or spray-drying process. In small scale examples, the precursor material is freeze-dried using freeze-drying microscopy, for example using a Lyostat freeze-drying microscope.

In a spray-drying process, the precursor material is sprayed and rapidly dried using a hot gas. The use of spray drying provides several advantages to the present invention: the dry particle size can be controlled and may be consistent; tobacco or flavor extracts or materials are heat sensitive but can still be spray-dried at relatively high inlet temperatures; a short residence time in the spray-drying equipment is required; and minimal loss of flavor/volatiles. This makes the process adaptable to reduce loss of volatile compounds and maintain the desired flavor of the aerosol generating material.

Freeze-drying, also known as lyophilization or cryodesiccation, is a process in which the precursor material is frozen, the temperature lowered and the water is removed via sublimation under reduced pressure conditions. Without wishing to be bound by any particular theory, it is believed that the low processing temperatures and rapid water loss via sublimation avoid changes in the aerosol-generating material's structure, appearance and characteristics. This process preserves the structure of the precursor material, and reduces the loss and decomposition of volatile flavor compounds.

The dried aerosol-generating material has a lower water content than the precursor material. The water content may be at most about 0.5 wt %, about 1 wt %, about 2%, about 5 wt %, about 10 wt %, or about 20 wt % (calculated on a wet weight basis). The water content of the dried aerosol-generating material may be reduced from the precursor material by at least about 50 wt %, about 60 wt %, about 70 wt %, about 80 wt %, about 90 wt %, about 95 wt %, about 98 wt %, or about 100 wt %. In some embodiments the dried aerosol-generating material has a water content of less than about 5 wt %, less than about 4 wt %, less than about 3 wt %, less than about 2 wt % or less than about 1 wt % (calculated on a wet weight basis), as measured by gas chromatography-thermal conductivity detector (GC-TCD) or Karl Fischer measurement.

In an exemplary embodiment of the invention, the precursor material comprises Burley tobacco extract and a water content of 60 wt %. After the freeze-drying operation described herein, the dried aerosol generating material has a water content of 3 wt %.

A lower water content of the dried aerosol-generating material is associated with longer shelf-life and stability. However, very low water content may be associated be a brittle structure and a smaller particle size, as well as taking longer to process. If the water content is too high on the other hand, the desired increased stability may not be achieved. The dried aerosol-generating material may also not be as easy to handle with higher water content.

The inventors have found that when the precursor material comprises a higher amount of excipient, the precursor material may be dried via spray-drying. Without wishing to be bound by any particular theory, it is speculated that increasing the amount of the excipient in the precursor material raises the glass transition temperature to above 100° C. and this affects the physical properties of the material, making it more suitable for spray drying.

The Dried Aerosol-Generating Material

The dried aerosol-generating material is stable at a greater range of temperatures and humidities than the corresponding precursor material, so this may be stored and/or transported for a much longer period without degradation. Without wishing to be bound by any particular theory, it is believed that the low water content of the dried aerosol-generating material reduces evaporation over time of other solvents, and reduces degradation of nicotine and/or other volatile compounds. A low water content also inhibits microbial growth. A benefit to the improved stability of the dried aerosol generation material is that freezer conditions are not required to store and transport the material. This makes both storage and transportation easier and cheaper to facilitate. Compared to a frozen tobacco material, the dried aerosol generating material is also lighter, and therefore is easier to transport.

The dried aerosol-generating material can be in any solid form. For example, the dried aerosol-generating material may be in granule, agglomerated, particulate, or powder form. The dried aerosol-generating material may be in the form of a "cake". The dried aerosol-generating material may then be further processed with other suitable steps as required and known to the person skilled in the art to provide the material in the form of particles of the desired size(s).

In some embodiments the dried aerosol-generating material is in the form of a gel. A gelling agent may be added to the dried aerosol-generating material, the precursor material or may be optionally omitted. The gelling agent may comprise one or more compounds selected from cellulosic gelling agents, non-cellulosic gelling agents, guar gum, acacia gum and mixtures thereof.

In some embodiments, the cellulosic gelling agent is selected from the group consisting of: hydroxymethyl cellulose, hydroxyethyl cellulose, hydroxypropyl cellulose, carboxymethylcellulose (CMC), hydroxypropyl methylcellulose (HPMC), methyl cellulose, ethyl cellulose, cellulose acetate (CA), cellulose acetate butyrate (CAB), cellulose acetate propionate (CAP) and combinations thereof.

In some embodiments, the gelling agent comprises (or is) one or more of hydroxyethyl cellulose, hydroxypropyl cellulose, hydroxypropyl methylcellulose (HPMC), carboxymethylcellulose, guar gum, or acacia gum.

In some embodiments, the gelling agent comprises (or is) one or more non-cellulosic gelling agents, including, but not limited to, agar, xanthan gum, gum Arabic, guar gum, locust bean gum, pectin, carrageenan, starch, alginate, and combinations thereof. In preferred embodiments, the non-cellulose based gelling agent is alginate or agar.

The dried aerosol-generating material, for example, an amorphous solid, may comprise a colorant. The presence of colorant may enhance the visual appearance of the aerosol-generating material. By adding a colorant to the dried aerosol-generating material, the dried aerosol-generating material may be color-matched to other components of the aerosol-generating material or to other components of an article comprising the dried aerosol-generating material.

A variety of colorants may be used depending on the desired color of the dried aerosol-generating material. The color of dried aerosol-generating material may be, for example, white, green, red, purple, blue, brown or black.

Other colors are also envisaged. Natural or synthetic colorants, such as natural or synthetic dyes, food-grade colorants and pharmaceutical-grade colorants may be used. In certain embodiments, the colorant is caramel, which may confer to the aerosol-generating material a brown appearance. In such embodiments, the color of the aerosol-generating material may be similar to the color of other components (such as tobacco material) included with the dried aerosol-generating material. In some embodiments, the addition of a colorants to the dried aerosol-generating material renders it visually indistinguishable from other components included or blended with the aerosol-generating material.

The colourant may be incorporated during the formation of the dried aerosol generating material (e.g. when forming a slurry comprising the materials that form an amorphous solid) or it may be applied to the dried aerosol-generating material after its formation (e.g. by spraying it onto the amorphous solid).

The aerosol-generating material may comprise an acid. The acid may be an organic acid. In some of these embodiments, the acid may be at least one of a monoprotic acid, a diprotic acid and a triprotic acid. In some such embodiments, the acid may contain at least one carboxyl functional group. In some such embodiments, the acid may be at least one of an alpha-hydroxy acid, carboxylic acid, dicarboxylic acid, tricarboxylic acid and keto acid. In some such embodiments, the acid may be an alpha-keto acid.

In some such embodiments, the acid may be at least one of succinic acid, lactic acid, benzoic acid, citric acid, tartaric acid, fumaric acid, levulinic acid, acetic acid, malic acid, formic acid, sorbic acid, benzoic acid, propanoic and pyruvic acid.

Suitably the acid is lactic acid. In other embodiments, the acid is benzoic acid. In other embodiments the acid may be an inorganic acid. In some of these embodiments the acid may be a mineral acid. In some such embodiments, the acid may be at least one of sulphuric acid, hydrochloric acid, boric acid and phosphoric acid. In some embodiments, the acid is levulinic acid.

The inclusion of an acid is particularly preferred in embodiments in which the aerosol-generating material comprises nicotine. In such embodiments, the presence of an acid may stabilize dissolved species in the slurry from which the aerosol-generating material is formed. The presence of the acid may reduce or substantially prevent evaporation of nicotine during drying of the slurry, thereby reducing loss of nicotine during manufacturing.

In certain embodiments, the aerosol-generating material comprises a gelling agent comprising a cellulosic gelling agent and/or a non-cellulosic gelling agent, an active substance and an acid.

In some embodiments, the aerosol-generating material comprises one or more cannabinoid compounds selected from the group consisting of: cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM) and cannabielsoin (CBE), cannabicitran (CBT).

The aerosol-generating material may comprise one or more cannabinoid compounds selected from the group consisting of cannabidiol (CBD) and THC (tetrahydrocannabinol).

The aerosol-generating material may comprise cannabidiol (CBD).

The aerosol-generating material may comprise nicotine and cannabidiol (CBD).

The aerosol-generating material may comprise nicotine, cannabidiol (CBD), and THC (tetrahydrocannabinol).

In some embodiments, the dried aerosol-generating material is in the form of granules. The granules may be of any size, cross-sectional shape or mass. The dried aerosol-generating material in the form of granules is advantageous due to the high surface area to volume ratio, which positively impacts the release of volatiles from the material. This form also facilitates incorporation of the material into an aerosol provision system.

In some embodiments, the dried aerosol-generating material is free-flowing and non-sticky, and this aids handling of the dried aerosol-generating material.

Smaller granule particles have a greater surface area to volume ratio and they may therefore exhibit enhanced release of tobacco constituents compared to particles of larger sizes.

In some embodiments, the size of the particles of the dried aerosol-generating material may be selected to provide a desired release profile of one of more components of the dried aerosol-generating material. In general, particles with a smaller particle size will release components more quickly upon use and for a shorter period of time. Particles with a larger particle size will release components more gradually and for a longer period. In some embodiments, particles of different sizes may be selected to provide a release profile that starts rapidly upon commencement of use of the aerosol-generating material, and continues over an extended period of use.

In some embodiments, it may be desirable for the particles in the precursor composition, to have an average particle size of no greater than about 3 mm, of no greater than 1 mm, of no greater than about 0.5 mm, or to have an average particle size of no greater than about 0.3 mm, when measured by sieving.

In some embodiments, the average particle size is within the range of about 0.1 to about 3 mm, of about 0.1 to about 1 mm, of about 0.1 to about 0.5 mm, of about 0.1 to about 0.4 mm, or in the range of about 0.2 to about 0.3 mm. In some embodiments, at least about 90% of the particles of the precursor composition will have a particle size within the range of about 0.1 to about 3 mm, or of about 0.1 to about 1 mm, or of about 0.1 to about 0.5 mm. In some embodiments, at least about 90% of the tobacco particles of the precursor composition will have a particle size within the range of about 0.1 to about 3 mm, or of about 0.1 to about 1 mm, or of about 0.1 to 0.5 mm. In some embodiments, none of the particles in the precursor composition have a particle size greater than 5 mm, greater than 4 mm, greater than 2 mm, greater than 1.5 mm, or greater than about 1 mm. In some embodiments, the average particle size is less than 1 mm.

Particles of the desired size may be formed by grinding, shredding, cutting or crushing tobacco material. The particles of the desired size may also be formed naturally through the spray-drying or freeze-drying process. Suitable machinery to create such tobacco particles includes, for example, shredders, cutters, or mills, such as hammer mills, roller mills or other types of commercially available milling machinery. The size of the tobacco particles is selected to provide particles which can be readily prepared from a variety of different types of tobacco material, having the properties described herein, and which provide a source of tobacco constituents that are readily released. Particles of a smaller size may be advantageous for aerosol generation. Without wishing to be bound by any particular theory, smaller particles may have a greater surface area to volume ratio, which may improve aerosol generation. It has been found that freeze-dried formulations can readily form particles with an average size of smaller than 1 mm.

In some embodiments, the dried aerosol-generating material may comprise at least about 45 wt %, at least about 50 wt %, at least about 60 wt %, at least about 70 wt %, at least about 80 wt %, at least about 90 wt %, or at least about 95 wt % tobacco material or tobacco extract, or flavor- or active-substance containing plant material extract (calculated on a dry weight basis). In some embodiments, the dried aerosol-generating material may comprise about 60 to about 80 wt % tobacco extract (calculated on a dry weight basis). In some embodiments, the dried aerosol-generating material may comprise about 3-6 wt % of nicotine (calculated on a dry weight basis).

In some embodiments, the dried aerosol-generating material may comprise at least about 45 wt %, at least about 50 wt %, at least about 60 wt %, at least about 70 wt %, at least about 80 wt %, at least about 90 wt %, or at least about 95 wt %, and/or up to about 99 wt %, up to about 98 wt %, up to about 95 wt %, up to about 90 wt % or up to about 80 wt % tobacco solids (calculated on a dry weight basis). In some embodiments, the dried aerosol-generating material may comprise about 60 to about 80 wt % tobacco solids (calculated on a dry weight basis).

In some embodiments, the dried aerosol-generating material may comprise at least about 1 wt %, at least about 5 wt %, at least about 10 wt %, at least about 20 wt %, at least about 30 wt %, or at least about 40 wt % aerosol-former material (calculated on a dry weight basis). In some embodiments, the dried aerosol-generating material may comprise up to about 40 wt %, up to about 30 wt %, up to about 20 wt %, up to about 15 wt %, up to about 10 wt %, or up to about 5 wt % aerosol-former material (calculated on a dry weight basis).

In some embodiments, the dried aerosol-generating material may comprise about 1 to about 34 wt %, or from about 17 to about 34 wt % aerosol-former material (calculated on a dry weight basis). In some embodiments in which the aerosol-former material is glycerol, the dried aerosol-generating material may comprise about 13-34 wt % glycerol (calculated on a dry weight basis).

In embodiments in which Burley tobacco is used, the dried aerosol-generating material may comprise 17-36 wt % of glycerol. The amount of glycerol in the dried aerosol material is important because it is both an aerosol-forming material and a plasticizer. If the concentration of glycerol is too high, it may be detrimental to the critical temperature of the product during the freeze-drying process and may result in collapse of the product if a critical temperature of the formulation is exceeded. On the other hand, sufficient glycerol should be included to provide the consumer with an adequate and pleasing aerosol.

In some embodiments, an aerosol-former material is included in the precursor material that is dried to form the aerosol-generating material. Additionally or alternatively, an aerosol-former material may be added to the dried aerosol-generating material after it has been formed.

In some embodiments, the dried aerosol-generating material may comprise at least about 0%, at least about 10 wt %, at least about 20 wt %, or at least about 25 wt % excipient (calculated on a dry weight basis). In some embodiments, the dried aerosol-generating material may comprise up to about 25%, up to about 20 wt %, up to about 15 wt %, or up to about 10 wt % excipient (calculated on a dry weight basis).

In an exemplary embodiment, the dried aerosol-generating material comprises about 36 wt % glycerol, about 45 wt % tobacco extract, and about 19 wt % excipient on a dry weight basis.

In another exemplary embodiment, the dried aerosol-generating material comprises about 17-39 wt % glycerol, 41-76 wt % tobacco extract, and 0-28 wt % excipient on a dry weight basis.

Incorporation into an Aerosol-Generating Device.

In some embodiments, the dried aerosol-generating material is provided in a consumable.

A consumable is an article comprising aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor. The consumable may be any shape or size that is appropriate to the smoking device. In a preferred embodiment of the invention, the consumable is a rod shape.

In some embodiments, the dried aerosol-generating material is provided in an aerosol-generating device such as a tobacco-heating product (THP) or hybrid e-cigarette product. Advantageously, the dried aerosol-generating material may be used directly as a solid substrate and the dried aerosol-generating material is directly heated without burning to provide an inhalable aerosol. Heating the material may aerosolize components of the aerosol-generating material, for example the glycerol, nicotine and/or tobacco flavor. The dried aerosol-generating material may be stored in reduced humidity conditions, for example less than about 30% humidity, prior to use.

An additional benefit of the dried aerosol-generating material being used directly as a solid substrate is that the low water content reduces issues associated with "hot puff", which are known in the art.

In another embodiments, the dried aerosol-generating material is rehydrated before being provided as a rehydrated aerosol-generating material for incorporation into a delivery system. Such rehydrated aerosol-generating materials may be used in a non-combustible aerosol provision system, such as a hybrid device, in which an aerosolizable material such as an e-liquid is heated to generate a vapor and/or aerosol which passes through or over the tobacco-containing aerosol generating material to pick up components including nicotine and (tobacco derived) flavors and aromas. The rehydrated dried aerosol-generating material may be a "slurry". The rehydrated dried aerosol-generating material may be a gel. The dried aerosol-generating material may rehydrated with an excess quantity of water, or with a suitable amount of water in line with the requirements for the end product. For example, some embodiments of the invention may be rehydrated with a 20:1 excess of water or a 6:1 excess of water.

In some embodiments, the water content of the rehydrated dried aerosol-generating material is at least about 10%, at least about 20%, at least about 30%, at least about 40%, at least about 50%, at least about 60%, at least about 70%, at least about 80%, or at least about 90%.

In some embodiments, the dried aerosol-generating material may be rehydrated by exposing the dried aerosol-generating material to an ambient or humid environment. The humidity of said environment may be at least about 25%, at least about 30%, at least about 35%, at least about 40%, at least about 50%, at least about 60%.

In another aspect, the dried aerosol-generating material is rehydrated and applied to a web or fibrous paper material to provide reconstituted tobacco. This process may be analogous to the existing process of preparing reconstituted tobacco by applying tobacco extract to fibrous paper material, and modified by replacing the tobacco extract with the rehydrated aerosol-generating material. This is advantageous as the aerosol-generating material can be incorporated into an existing manufacturing process, but with the improved shelf life as discussed herein.

"Paper reconstituted tobacco" refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibers) by deposition of the extract onto the fibrous material. The process of recombination resembles the process for making paper.

The paper reconstituted tobacco described herein may be prepared by methods which are known to those skilled in the art for preparing paper reconstituted tobacco.

Delivery Systems

The delivery systems described herein can be combustible aerosol provision systems, non-combustible aerosol provision systems or an aerosol-free delivery systems.

As used herein, the term "delivery system" is intended to encompass systems that deliver at least one substance to a user, and includes:

- combustible aerosol provision systems, such as cigarettes, cigarillos, cigars, and tobacco for pipes or for roll-your-own or for make-your-own cigarettes (whether based on tobacco, tobacco derivatives, expanded tobacco, reconstituted tobacco, tobacco substitutes or other smokable material);
- non-combustible aerosol provision systems that release compounds from an aerosol-generating material without combusting the aerosol-generating material, such as electronic cigarettes, tobacco heating products, and hybrid systems to generate aerosol using a combination of aerosol-generating materials; and
- aerosol-free delivery systems that deliver the at least one substance to a user orally, nasally, transdermally or in another way without forming an aerosol, including but not limited to, lozenges, gums, patches, articles comprising inhalable powders, and oral products such as oral tobacco which includes snus or moist snuff, wherein the at least one substance may or may not comprise nicotine.

According to the present disclosure, a "combustible" aerosol provision system is one where a constituent aerosol-generating material of the aerosol provision system (or component thereof) is combusted or burned during use in order to facilitate delivery of at least one substance to a user.

In some embodiments, the delivery system is a combustible aerosol provision system, such as a system selected from the group consisting of a cigarette, a cigarillo and a cigar.

In some embodiments, the disclosure relates to a component for use in a combustible aerosol provision system, such as a filter, a filter rod, a filter segment, a tobacco rod, a spill, an aerosol-modifying agent release component such as a capsule, a thread, or a bead, or a paper such as a plug wrap, a tipping paper or a cigarette paper.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energized so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

FIG. 1 is a side-on cross sectional view of a consumable or article 1 for use in an aerosol delivery system. The article 1 comprises a mouthpiece segment 2, and an aerosol generating segment 3.

The aerosol generating segment 3 is in the form of a cylindrical rod and comprises a dried or rehydrated aerosol-generating material 4. The dried or rehydrated aerosol-generating material can be any of the materials discussed herein.

Although described above in rod form, the aerosol-generating segment 3 can be provided in other forms, for instance a plug, pouch, or packet of material within an article.

The mouthpiece segment 2, in the illustrated embodiment, includes a body of material 5 such as a fibrous or filamentary tow.

The rod-shaped consumable 1 further comprises a wrapper 6 circumscribing the mouthpiece segment 2 and aerosol generating segment 3, such as a paper wrapper.

Figure 2:
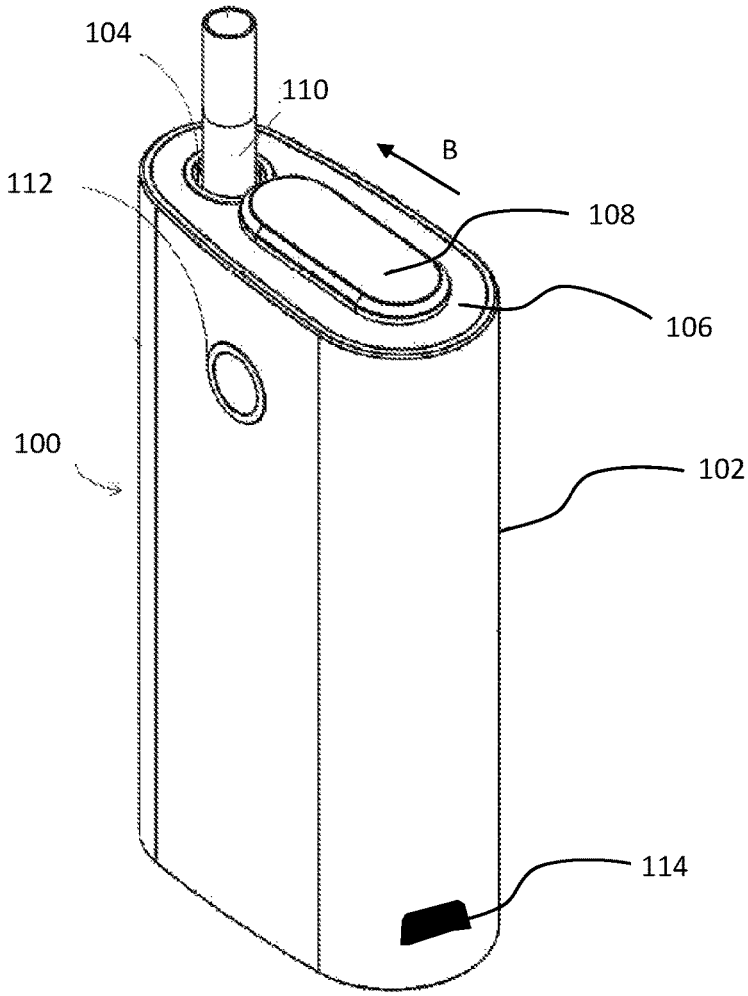
FIG. 2 is a perspective illustration of a non-combustible aerosol provision device for generating aerosol from the aerosol-generating material of the consumable shown in FIG. 1.

FIG. 2 shows an example of a non-combustible aerosol provision device 100 for generating aerosol from an aerosol-generating medium/material such as the aerosol-generating material of a consumable 110, as described herein. In broad outline, the device 100 may be used to heat a replaceable article 110 comprising the aerosol-generating medium, for instance an article 1 as illustrated in FIG. 1 or as described elsewhere herein, to generate an aerosol or other inhalable medium which is inhaled by a user of the device 100. The device 100 and replaceable article 110 together form a system.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

The device 100 of this example comprises a first end member 106 which comprises a lid 108 which is moveable relative to the first end member 106 to close the opening 104 when no article 110 is in place. In FIG. 2, the lid 108 is shown in an open configuration, however the lid 108 may move into a closed configuration. For example, a user may cause the lid 108 to slide in the direction of arrow "B".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

In some embodiments, the substance to be delivered may be an aerosol-generating material or a material that is not intended to be aerosolized. As appropriate, either material may comprise one or more active constituents, one or more flavors, one or more aerosol-former materials, and/or one or more other functional materials.

In some embodiments, the aerosol-generating material described herein is not used to generate an aerosol. Rather, the so-called aerosol-generating material is to be used in an aerosol-free delivery system that delivers at least one component from the aerosol-generating material to a user orally, nasally, transdermally or by any other suitable route of administration, without forming an aerosol. In some embodiments, the aerosol-generating material is incorporated into a product selected from the group consisting of: lozenges, gums, pouches, patches, and inhalable powders.

Stability

The invention enjoys the advantage of longer shelf life than other tobacco extracts.

The nicotine content of the precursor and dried aerosol-generating material after the freeze drying process has been calculated, providing an indication of the amount of nicotine retained following the processing. Compared to the original tobacco extract, the nicotine recovery of the dried aerosol generating material is at least about 76 wt % on a dry weight basis. The nicotine recovery of the dried aerosol generating material compared to the original tobacco extract may be at least about 60%, at least about 70%, at least about 75%, at least about 80%, or at least about 90% on a dry weight basis.

The glycerol content of the precursor and dried aerosol-generating material after the freeze drying process has been calculated, providing an indication of the amount of glycerol retained following the processing. Compared to the precursor material, the glycerol recovery of the dried aerosol generating material is at least about 85%. The glycerol recovery of the dried aerosol generating material compared to the precursor material may be at least about 70%, at least about 75%, at least about 80%, at least about 85%, at least about 90% at least about 95% on a dry weight basis.

Example 1

In a first test, the precursor material comprised essentially of aqueous tobacco extract, and glycerol. The aqueous tobacco extract was diluted further with glycerol up to about 24 wt % (calculated on a dry weight basis). The Burley aqueous tobacco extract had a tobacco solid content of about 40 wt %, and a water content of about 60 wt %. The precursor material was dried via freeze drying.

Example 2

In a further test, the precursor material comprised essentially of aqueous tobacco extract, glycerol and Dextran 70. The glycerol content was about 0 to about 15 v/v %, or up to about 36 wt % calculated on a dry weight basis. The precursor material was dried via freeze drying.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A dried aerosol-generating material comprising a spray-dried or freeze-dried precursor material, the precursor material comprising an extract from a flavor- and/or active-containing plant material and an aerosol-former material and wherein the precursor material is in the form of a suspension or liquid.

2. A dried aerosol-generating material as claimed in claim 1, wherein the aerosol-former material is glycerol.

3. A dried aerosol-generating material as claimed in claim 1, the precursor material further comprising at least one excipient, optionally wherein the precursor material comprises up to about 40% by weight excipient.

4. A dried aerosol-generating material as claimed in claim 3, wherein the excipient is one or more selected from the group consisting of mannitol, sucrose, trehalose, lactose, sorbitol, raffinose, maltose, Dextran 10, Dextran 70, Dextran 90, maltodextrin, gelatin, agar, cyclodextrin, PEG 2000-6000 and polyvinylpyrrolidone (PVP) (10k).

5. A dried aerosol-generating material as claimed in claim 1, the precursor material comprising from about 10 to about 95% by weight extract from a flavor- or active-containing plant material.

6. A dried aerosol-generating material as claimed in claim 1, the precursor material comprising from about 1 to about 36 wt % aerosol-former material.

7. A dried aerosol-generating material as claimed in claim 1, comprising from about 99 to about 45% by weight dried extract from the flavor- or active-containing plant material.

8. A dried aerosol-generating material as claimed in claim 1, comprising from about 1 to about 34% by weight aerosol-former material.

9. A dried aerosol-generating material as claimed in claim 1, comprising from about 0 to about 25% by weight excipient.

10. A dried aerosol-generating material as claimed in claim 1, wherein the plant material is selected from the group consisting of tobacco, eucalyptus, star anise, cocoa and hemp.

11. A dried aerosol-generating material as claimed in claim 1, wherein the extract from a flavour- or active-containing plant material is an aqueous extract.

12. A dried aerosol-generating material as claimed in claim 11, wherein the extract from a flavor- or active-containing plant material is an aqueous tobacco extract, optionally comprising from about 40 to about 99% by weight tobacco solids.

13. A dried aerosol-generating material as claimed in claim 1, wherein the dried aerosol-generating material is in the form of granules, optionally wherein granules have a particle size that is at most about 3 mm.

14. A dried aerosol-generating material as claimed in claim 1, having a water content of no more than about 4%.

15. A dried aerosol-generating material as claimed in claim 1 for use in an aerosol provision system.

16. A non-combustible aerosol-provision system comprising a dried aerosol-generating material as claimed in claim 1.

17. A method of providing a dried aerosol-generating material comprising spray-drying or freeze-drying a precursor material, the precursor material being in the form of a suspension or liquid and comprising an extract from a flavor- and/or active-containing plant material and an aerosol-former material.

18. A method of providing an aerosol-generating material comprising contacting the dried aerosol-generating material as claimed in claim 1 with water.

19. A method as claimed in claim 18, wherein contacting the dried aerosol-generating material with water comprises exposing the dried aerosol-generating material to a humid environment.

20. A method as claimed in claim 18, wherein an aerosol-generating material is provided in the form of a solid, liquid or gel aerosol-generating material, optionally wherein a solid amorphous material is formed from the dried aerosol-generating material.

21. A dried aerosol-generating material as claimed in claim 1, wherein a water content of the dried aerosol-generating material is reduced from the precursor material by at least about 50 wt %.

* * * * *